United States Patent [19]

Miller

[11] 4,002,302

[45] Jan. 11, 1977

[54] REDUCING MACHINE HAVING A POSITIVELY DISPLACED GRATE

[75] Inventor: Donald G. Miller, Glendale, Mo.

[73] Assignee: American Pulverizer Company, St. Louis, Mo.

[22] Filed: Jan. 21, 1976

[21] Appl. No.: 651,120

[52] U.S. Cl. ..... 241/89; 241/89.1

[51] Int. Cl.[2] ..... B02C 13/284

[58] Field of Search ..... 241/89, 89.1, 89.2

[56] References Cited

UNITED STATES PATENTS

| | | | |
|---|---|---|---|
| 977,799 | 12/1910 | Hiller | 241/89 |
| 1,020,501 | 3/1912 | Hiller | 241/89.1 |
| 1,361,054 | 12/1920 | Hartman et al. | 241/89.1 |
| 1,781,891 | 11/1920 | Borton | 241/89 |
| 1,824,272 | 9/1931 | Jamison | 241/89 |
| 2,819,027 | 1/1958 | Neely | 241/89.1 |

*Primary Examiner*—Granville Y. Custer, Jr.
*Attorney, Agent, or Firm*—Gravely, Lieder & Woodruff

[57] ABSTRACT

The cage of a reducing machine is positioned within the machine housing below the rotor. One end of the cage is pivoted with respect to the machine housing, while the other end is suspended from chains which pass over sprockets so that when the sprockets are rotated the cage is either elevated or permitted to descend. Should the cage fail to descend under its own weight, a downwardly directed force is applied to it by pintle-type gears which mesh with gear segments on the cage. The rotation of the gears and the movement of the chains are synchronized.

9 Claims, 4 Drawing Figures

REDUCING MACHINE HAVING A POSITIVELY DISPLACED GRATE

BACKGROUND OF THE INVENTION

This invention relates in general to reducing machines, and more particularly to a reducing machine having a cage which is positively displaced both toward and away from the rotor of the machine.

Coal as it is taken from the mine is primarily in lump form, with the lumps being much too large for use in stokers and coal burning equipment. Usually, the coal is passed through a reducing machine, called a coal crusher, to reduce it to uniform size suitable for use in coal burning equipment.

The typical coal crusher has a housing and a rotor which revolves in the housing. The rotor carries breaking elements which strike the coal and reduce it in size. The housing also contains a cage which is below the rotor, and this cage is provided with a screening device through which the reduced fragments of coal will pass when they reach the desired size.

In the course of operation the coal tends to clog the openings of the cage screen, and it is therefore desirable to have the cage drop downwardly so that it may be cleaned. Indeed, it is common practice to clean such screens at least once a day. When the coal contains mud, the cleaning must occur more often. Not only does the drop-type cage facilitate cleaning, but it also enables the machine to be cleared of coal prior to start up. In this regard, sometimes coal from overhead conveyors and chutes will migrate into idle machines and will accumulate on the screens thereof. However, the machines cannot be started under load, and hence must be completely cleared of the accumulated coal. The drop cage also enables the screens to be replaced with relative ease. Finally, the mechanism for dropping the cage affords a convenient means for adjusting the vertical position of the screen so as to compensate for wear of the breaking elements on the rotor. It also provides some control over the size of the coal fragments which are discharged through the screen.

Machines of current manufacture have cages which are suspended from chains passed over sprockets. The chains enable the cage to be dropped a substantial distance below the bottom of the machine so that convenient access to the screen and to the interior of the machine is available. The chains further exert an upwardly directed force on the cage so that it may be raised and held in a desired position beneath the rotor. However, the chains do not exert a downwardly directed force on the cage. Hence when the chain is released, the cage usually drops downwardly under its own weight, but sometimes coal and mud cakes between the cage and housing and holds the cage upwardly after the chain is released. When this occurs a force must be applied to the cage from within the machine, and this may be a time consuming and somewhat difficult procedure.

Heretofore machines have been developed with positive cage displacement in both directions, but the mechanisms utilized in these machines for moving their cages do not enable the cages to be dropped to near the extent possible with a chain suspension system.

SUMMARY OF THE INVENTION

One of the principal objects of the present invention is to provide a reducing machine having a chain suspended cage with means for applying a positive downwardly directed force to the cage so that it may be forced downwardly. Another object is to provide a machine of the type stated in which the means for applying the downwardly directed force to the cage is not easily clogged with material which is passed through the reducing machine. A further object is to provide a machine of the type stated in which the means for applying the downwardly directed force to the cage may be easily incorporated into existing machines having chain suspension systems. An additional object is to provide a machine having a cage which is easily cleaned, repaired, and maintained. Still another object is to provide a machine which is rugged and is dependable in operation. These and other objects and advantages will become apparent hereinafter.

The present invention is embodied in a reducing machine including a housing, a rotor in the housing, a cage in the housing below the rotor, an elongated flexible element for suspending the cage, and means for exerting a downwardly directed force on the cage. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
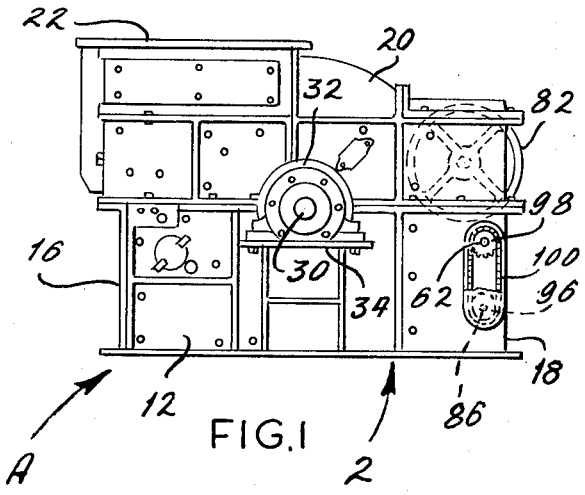
FIG. 1 is an elevational view showing the right side of the reducing machine of the present invention.

Referring now to the drawings (FIG. 3), a reducing machine basically includes a housing 2, a rotor 4, a cage 6, and a positioning mechanism 8. The rotor 4 is supported on and rotates within the housing 2, while the cage 6 is located within the housing 2 directly below the rotor 4. The positioning mechanism 8 raises and lowers the cage 6. The machine A is ideally suited for reducing lump coal to a generally uniform fragment size suitable for use in stokers and coal burning equipment. It may also be used to reduce other material such as calcium carbide, bauxite, petroleum coke, fireclay, and alum, and with slight alterations to the cage 6 may be employed as a rock crusher.

The housing 2 has parallel side walls 12 and 14 (FIGS. 1 and 2) and parallel front and rear walls 16 and 18 which are connected across the ends of the side walls 12 and 14 to form a generally rectilinear enclosed space. The bottom of the housing 2 is completely open, but the top is partially closed by a top wall 20 which spans the space between the two side walls 12 and 14 and along its rear edge is connected to the rear wall 18. The top wall 20 is spaced from the other front wall 16, thereby forming a rectangular feed opening 22 (FIG. 3) in the housing 2 adjacent to the front wall 16. The housing 2 contains a breaker plate 24 which is pivoted adjacent to the upper end of the front wall 16 where it forms the front margin of the inlet opening 22. The breaker plate 24 extends downwardly from the inlet opening 22 and is inclined somewhat inwardly toward the rotor 4. Its lower end is positioned by an eccentric adjusting shaft 26 which is extended between the side walls 12 and 14.

Figure 3:
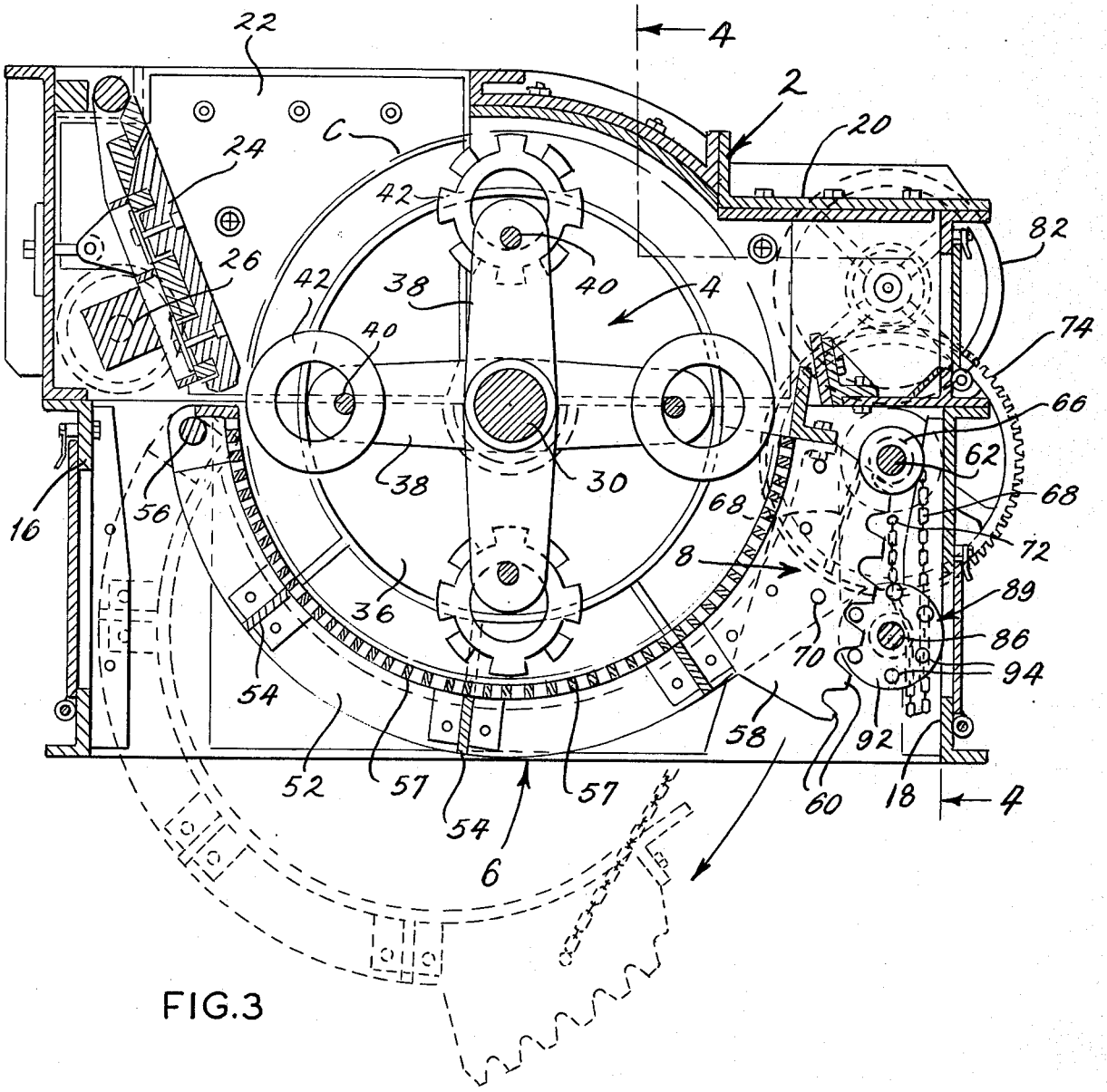
FIG. 3 is a longitudinal sectional view of the reducing machine with the cage thereof being illustrated in phantom when in the dropped position.
Figure 4:
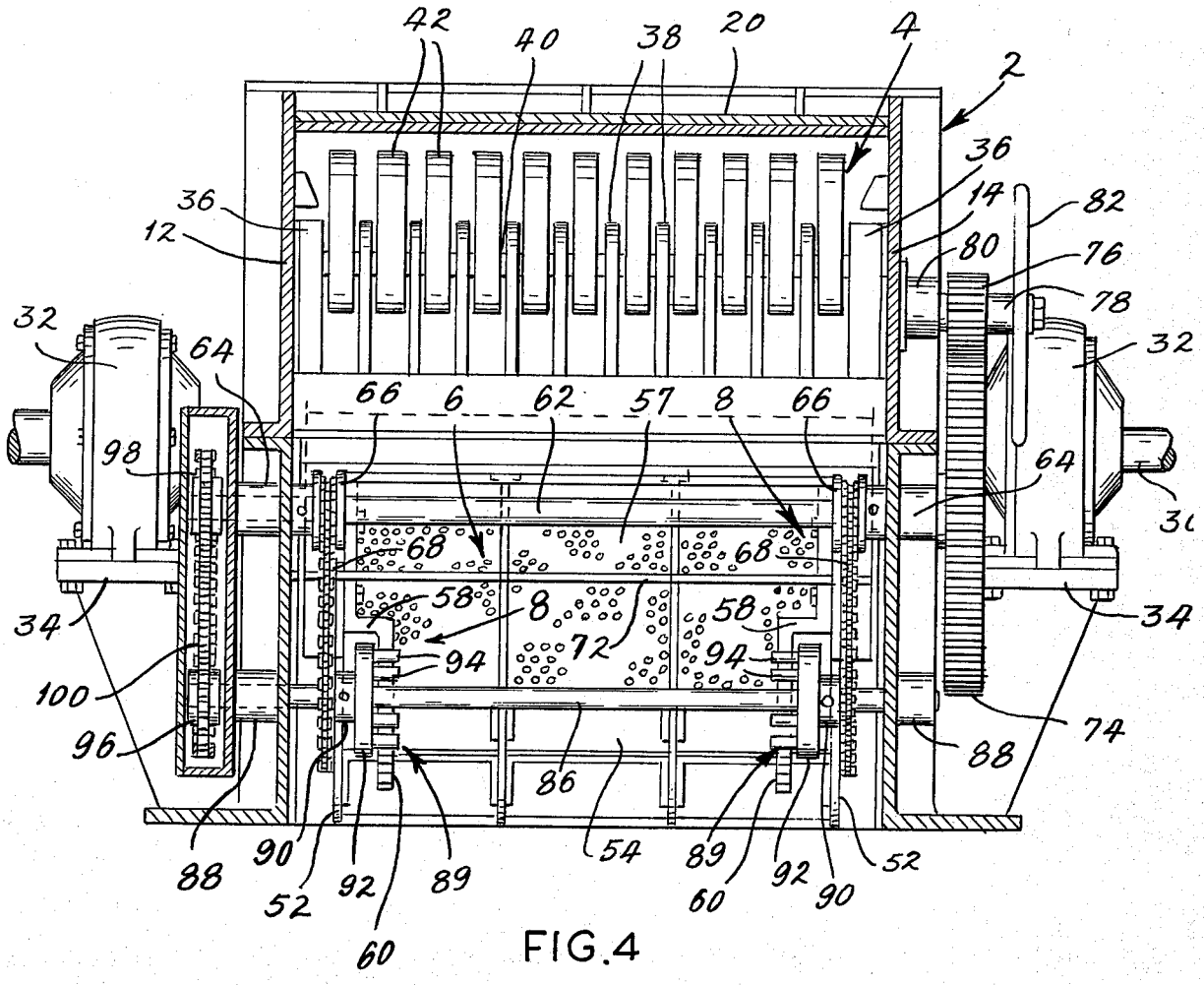
FIG. 4 is a sectional view taken along line 4—4 of FIG. 3.

The rotor 4 is for the most part disposed within the housing 2, and it includes a rotor shaft 30 which revolves in pillow block bearings 32 mounted on supporting plates 34 located adjacent the two side walls 12 and 14 of the housing 2. The shaft 30 extends through the side walls 12 and 14 and within the interior of the housing 2 is fitted with a pair of end disks 36 and a plurality of spiders or crossarms 38 between the end disks 36 (FIGS. 3 and 4). Extended through the spiders 38 near their tip ends, as well as through the end disks 36, are ring shafts 40. The ring shafts 40 pass through the hollow centers of shredder rings 42, which are positioned in the spaces between the spiders 38, and thereby retain the rings 42 on the rotor 4. The hollow interiors of the shredder rings 42 are perfectly circular and substantially larger in diameter than the shafts 40. Hence, the rings 42 fit very loosely on the shafts 40 and will move inwardly upon encountering an obstruction. When the rotor 4 revolves, the rings 42 move outwardly and describe a ring tip circle C (FIG. 3) which passes close to the lower end of the inclined breaker plate 24. The rotor 4 is powered by an electric or other suitable motor (not shown) which is connected to the rotor shaft 30.

The cage 6 is located beneath the rotor 4 (FIG. 3) with one of its ends being located immediately below the lower end of the breaker plate 24 so that the cage 6 generally forms a continuation of the breaker plate 24. The cage 6 occupies an arc of about 180° beneath the ring tip circle C.

The cage 6 includes a pair of arcuate side frames 52 which are connected together by cross members 54. One end of the cage 6 is supported on a pivot shaft 56 which extends through the upper ends of the side frames 52. The shaft 56 is parallel to the rotor shaft 30, and its ends are anchored in the side walls 12 and 14 of the housing 2. The opposite end of the cage 6 is supported by the positioning mechanism 8. Attached to the upper surfaces of the arcuate side frames 52 on the cage 6 are apertured screen plates 57 which possess an arcuate configuration and are normally disposed just beyond the ring tip circle C.

Bolted to the rear ends of the side frames 52 on the cage 6 are gear segments 58 (FIG. 3) having gear teeth 60 which project toward the end wall 18 and are arranged concentrically about axis of the pivot shaft 56. Each gear segment 58 possesses an offset configuration (FIG. 4), with the offset being inwardly and having the teeth 60 thereon. Thus, the teeth 60 of the gear segments 58 are located slightly inwardly from the side frames 52 to which the gear segments 58 are bolted.

The gear segments 58 actually form part of the positioning mechanism 8 (FIGS. 3 and 4) which in addition includes a drive shaft 62 which extends through the interior of the housing 2 at about the same elevation as the pivot shaft 56, but slightly rearwardly from the cage 6. The drive shaft 62 is parallel to rotor shaft 30 and its ends are received in bearings 64 (FIG. 4) fastened to the side walls 12 and 14. The portion of the drive shaft 62 located within the interior of the housing 2 is fitted with two chain sprockets 66, and these sprockets align generally with side frames 52 of the cage 6. The sprockets 66 accommodate load-type chains 68 and accordingly have pockets which receive the links of the chains 68. Sprockets of this nature are common to conventional chain hoists. The chains 68 pass over the sprockets 66. One end of each chain 68 is connected to a chain bracket 70 on the side frame 52 with which its sprocket 66 aligns, and the portions of those chains between the sprockets 66 and the side frames 52 are taut since they support the end of the cage 6. In other words, the rear end of the cage 6 is suspended from the chains 68. The opposite ends of the chains 68 are connected to a chain hanger 72 which extends through the housing 2 directly below the drive shaft 62, and the chains 68 have substantial loops between the chain hanger 72 and the sprockets 66. Thus, when the drive shaft 62 is turned in one direction, the cage 6 drops downwardly, and when the drive shaft 62 is turned in the opposite direction the cage 6 is elevated.

Figure 2:
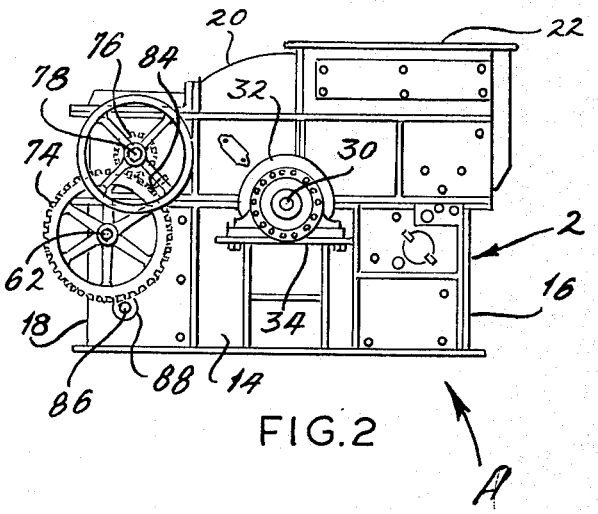
FIG. 2 is an elevational view of the left side of the machine.

The ends of the drive shaft 62 project beyond both of the bearings 64, and the end which is beyond the bearing on the side wall 14 is fitted with a spur gear 74 (FIGS. 2 and 4). The spur gear 74 meshes with a pinion gear 76 mounted on a shaft 78 which rotates in a bearing 80, that bearing being bolted to the side wall 14. The shaft 78 carries a hand wheel 82 for rotating it. This of course turns the pinion gear 76, which being engaged with the spur gear 74, rotates the spur gear 74 as well as the drive shaft 62 and the chain sprockets 66. Mounted on the side wall 14 adjacent to the spur gear 74 is a lock pawl 84 (FIG. 2) which engages the teeth of the spur gear 74 and prevents that gear from turning in direction of the torque applied by the suspended cage 6.

Directly below the drive shaft 62 is a gear shaft 86 (FIGS. 3 and 4) which likewise has its end received in bearings 88 mounted on the sidewalls 12 and 14. The gear shaft 86 carries two pintle-type gears 89, each of which includes a hub 90 secured to the shaft 86, a disk 92 mounted on the hub 90 and projecting radially from it, and pintles 94 projected axially from the disk 92. The pintles 94 are arranged in a circle and are spaced at equal circumferential intervals with the arcuate length of those intervals equaling the pitch of the teeth 60 on the gear segment 58. Indeed, the disks 92 project behind the offset portions of the two gear segments 58 (FIG. 4) where the pintles 94 extend axially through the spaces between the teeth 60 on the gear segments 58. The fit is rather loose, and teeth 60 are separated by concave depressions which generally conform to the cylindrical side faces of the pintles 94. Thus, as the pintle gears 89 revolve, the pintles 94 thereon pass into and out of the spaces between the teeth 60 of the gear segments 58 and thereby follow the gear segments 58 as they move upwardly or downwardly.

The end of the gear shaft 86 at the side wall 12 projects beyond the bearing 88 on that side wall, and this end is fitted with a roller chain sprocket 96 (FIGS. 1 and 4). Likewise the corresponding end of the drive shaft 62 is fitted with a roller chain sprocket 98 which aligns with the sprocket 96. Both sprockets 96 and 98 are located externally of the housing 2 and trained around these sprockets is a roller chain 100. Thus, when the drive shaft 62 is turned by the hand wheel 82, the gear shaft 86 likewise rotates with the rotation being in the same direction. Moreover, the size of the load chain sprockets 66, the ratio between the pintle gears 89 and the gear segments 58, and the ratio between the roller chain sprockets 96 and 98 are all such that the pintle gears 89 follow the gear segments 58 upwardly and downwardly without any binding. In other words, the pintle gears 89 rotate such that they are synchronized with the movement of the load chains 68.

OPERATION

Coal or any other material that is to be reduced in size is introduced into the feed opening 22 of the housing 2, and this material drops downwardly over the breaker plate 24. Normally the shredder rings 42 on the revolving rotor 4 strike the material before it reaches the upper end of the cage 6 and this fractures the material, reducing it in size. The material passes downwardly onto the screen plates 57 of the cage 6 and in this vicinity the rings 42 continue to reduce the size of the material until it is small enough to pass through the apertures in the screen plates 57. The material which passes through those apertures drops through the bottom of the housing 2, beyond which it may be collected on a conveyor.

When it is necessary to gain access to the screen plates 57 of cage 6 for repair, cleaning, or other purposes, the lock pawl 84 is disengaged from the spur gear 74 and the hand wheel 82 is rotated slowly in the direction which permits the cage 6 to descend. Normally the cage 6 will descend under its own weight and the hand wheel 82 merely prevents it from dropping too quickly. As the cage 6 descends the load chains 68 pay off the sprockets 66 and the loops to the rear of the sprockets 66 shorten. The pintles 94 on the gears 89, moreover, follow the cage 6 down by passing into and out of the spaces between the teeth 60 of the gear segments 58.

Should the cage 6 fail to descend by reason of material being lodged between its sides and the side walls 12 and 14 of the housing 2, no torque will be applied to the hand wheel 82 when the pawl 84 is released. Therefore instead of restraining the hand wheel 82, the hand wheel 82 must be forcibly turned in the direction which imparts slack to the portions of the load chains 68 located between cage 6 and sprockets 66. After a slight amount of slack develops, the pintles 94 on the gears 89 bear against those teeth of the gear segment 58 with which they are engaged, thus applying a downwardly directed force to the cage 6. In this connection, the torque which is manually applied to the hand wheel 82 is transferred to the gear shaft 86 to which the gears 89 are fitted by way of the pinion and spur gears 74 and 76, the drive shaft 62 and the roller chain 100 and its sprockets 96 and 98. The downwardly directed force applied to the cage 6 by the gears 89 frees the cage 6, and it drops very slightly, taking up the slight amount of slack in the chains 68. Thereafter, the cage 6 is restrained by the chains 68, and the gears 89 merely rotate through the teeth 60 on the gear segments 58.

In time, the upper ends of the gear segments 58 pass beyond the pintle gears 89 (FIG. 3 — phantom lines), but the gears 89 continue to rotate inasmuch as the gear shaft 86 is connected to the drive shaft 62 through the roller chain 100 and its sprockets 96 and 98.

The chains 68 permit the front end of the cage 6 to be lowered a substantial distance below the bottom of the housing 2 so that the entire cage 6 is easily accessible for cleaning and maintenance (FIG. 3). Thus, insofar as control over the position of the cage 6 is concerned, the pintle gears 89 are effective through a limited range while the chains 68 and sprockets 66 are effective through an extended range of greater magnitude.

When the cleaning or maintenance is completed, the hand wheel 82 is turned in the opposite direction, and this rotates the sprockets 66 such that the chains 68 are drawn upwardly, thus hoisting the grate 6 upwardly. The gears 89 on the gear shaft 86 also rotate in the opposite direction and remain synchronized with the chains 68. Hence when gear segments 58 reach the gears 89, the pintles 94 of the gears 89 align with the spaces between the teeth 60 on the gear segments 58 so that the gears 89 and gear segments 58 mesh perfectly. The pintle gears 89 remain meshed with the gear segments 58 as the cage 6 moves still further upwardly to its operating position, that is the position in which the screen plates 57 are located immediately below the ring tip circle C.

Once the cage 6 is elevated to its operating position, the lock pawl 84 is moved into engagement with the spur gear 74 and this holds the cage 6 in the position to which it is elevated. To compensate for wear of the shredder rings 42, the cage 6 may be elevated still further by turning the hand wheel 82. Likewise, the eccentric shaft 26 is turned to move the lower end of the breaker plate 24 closer to the ring tip circle C. These adjustments permit variations in the size of the fragmented material delivered by the machine A. For example, the fragment size becomes smaller when the cage 6 and breaker plate 24 are moved closer to the ring tip circle C.

It is apparent that the positioning mechanism 8 exerts both upwardly and downwardly directed forces on the rear end of the cage 6, depending on the direction in which the hand wheel 82 is turned. Therefore, should the cage 6 become stuck due to material caking between it and the side walls 12 and 14 of the housing 2, the positioning mechanism will free the cage 6 so that it will drop downwardly in the usual manner.

Since a relatively large amount of clearance exists between the pintles 94 of the pintle gears 89 and the teeth 60 of the gear segments 58, fines which accumulate in the spaces between the gear teeth 60 do not jam the gears 89. Moreover, the pintles 94 are cylindrical, while the teeth 60 are completely open on both sides so that any material which does accumulate in the spaces between the teeth 60, is easily displaced out of the sides of the gear segments 58 by the pintles 94. The positioning mechanism 8 may, without much difficulty, be placed on existing machines having chain-suspended cages.

This invention is intended to cover all changes and modifications of the example of the invention herein chosen for purposes of the disclosure which do not constitute departures from the spirit and scope of the invention.

What is claimed is:

1. A reducing machine comprising: a housing having an inlet through which material is introduced; a rotor which revolves in the housing and has breaker elements which pass by the inlet and strike the material, reducing the material to a smaller size; a cage located in the housing beneath the rotor and having apertures through which the reduced material passes; a chain suspending the cage from the housing so as to retain the cage in the proper position beneath the rotor; a sprocket rotatable in the housing and having the chain passed over it such that when the sprocket is rotated in one direction the chain will pay off of the sprocket and the cage will be permitted to descend and when rotated in the opposite direction the chain will be drawn over the sprocket and the cage will be elevated; and means for exerting a downwardly directed force on the cage so as to urge the cage downwardly in the event that it fails to descend under its own weight when the chain is released, the means for exerting a downwardly directed force on the cage comprising a gear segment on the cage and a gear in the housing and meshed with the gear segment, the sprocket and gear rotating in unison such that the rotation of the gear is synchronized with the movement of the chain, the chain being of sufficient length to enable the cage to drop downwardly past the point at which the gear is engaged with the gear segment.

2. A reducing machine according to claim 1 wherein the gear and the sprocket are mounted on shafts which are parallel to the axis of rotation for the rotor.

3. A reducing machine according to claim 2 wherein the gear comprises a disk and pintles arranged in a circle on the disk and projecting axially from the disk, the pintles meshing with the teeth of the gear segment.

4. A reducing machine according to claim 2 wherein the gear segment is at one end of the cage, the chain is connected to the same end of the cage, and the other end of the cage pivots about an axis fixed in position with respect to the housing.

5. A reducing machine according to claim 2 and further comprising a hand wheel on the housing and gears connecting the hand wheel with the shaft on which the sprocket is mounted, whereby when the hand wheel is rotated, the sprocket will revolve so as to either raise the cage or permit it to descend.

6. A reducing machine comprising: a housing having an inlet through which material is introduced; a rotor which revolves in the housing and has breaking elements which strike the material introduced through the inlet and reduce it to a smaller size, the breaking elements describing a circle as they revolve in the housing; an arcuate cage located beneath and generally conforming to the curvature of the circle described by the breaking elements, the cage having apertures through which the reduced material passes, one end of the cage being pivoted about an axis which is fixed in position with respect to the housing to enable the cage to move downward through an extended range of movement; a chain connected to the other end of the cage and extended upwardly therefrom such that the other end of the cage is capable of being suspended by the chain over the extended range of movement; a first shaft on the housing and rotatable about an axis which is fixed in position with respect to the housing; a sprocket on the first shaft and having chain passing over it so that when the shaft is rotated in one direction the cage will be permitted to descend within the extended range, and when the shaft is rotated in the opposite direction the cage will be elevated within the extended range; means for rotating the first shaft and the sprocket upon it; and means for exerting a downwardly directed force on the cage within a limited range of movement to free the cage should it be incapable of descending under its own weight within the limited range when the sprocket is moved in the direction which permits the cage to descend, the means for exerting the downwardly directed force being connected to and powered by the means for rotating the first shaft, the limited range of movement being within the extended range of movement and further being of a lesser magnitude than the extended range, the positional relationship of the extended and limited ranges being such that the cage will be suspended by the chain after it drops downwardly out of the limited range.

7. A reducing machine according to claim 6 wherein the first and second shafts are connected for rotation together.

8. A reducing machine according to claim 6 wherein the gear includes a disk and pintles projecting axially from the disk, the pintles being arranged in a circle which is concentric to the axis of the second shaft, the pintles moving into the spaces between the teeth of the gear segment as the second shaft rotates.

9. A reducing machine comprising: a housing having an inlet through which material is introduced; a rotor which revolves in the housing and has breaking elements which strike the material introduced through the inlet and reduce it to a smaller size, the breaking elements describing a circle as they revolve in the housing; an arcuate cage located beneath and generally conforming to the curvature of the circle described by the breaking elements, the cage having apertures through which the reduced material passes, one end of the cage being pivoted about an axis which is fixed in position with respect to the housing; a chain connected to the other end of the cage and extended upwardly therefrom such that the other end of the cage is suspended by the chain; a first shaft on the housing and rotatable about an axis which is fixed in position with respect to the housing; a sprocket on the first shaft and having chain passing over it so that when the shaft is rotated in one direction the cage will be permitted to descend, and when the shaft is rotated in the opposite direction the cage will be elevated; means for rotating the first shaft and the sprocket upon it; and means for exerting a downwardly directed force on the cage to free the cage should it be incapable of descending under its own weight when the sprocket is moved in the direction which permits the cage to descend, the means for exerting the downwardly directed force comprising a gear segment at that end of the cage to which the chain is attached, a second shaft mounted on the housing for rotation about an axis which is fixed with respect to the housing, and a gear on the second shaft and meshing with the gear segment, the rotation of the gear being synchronized with the rotation of the sprocket and the movement of the chain, and the chain being of sufficient length to enable the cage to drop downwardly past the point at which the gear is engaged with the gear segment.

* * * * *